US005310092A

United States Patent [19]

Targell

[11] Patent Number: 5,310,092

[45] Date of Patent: May 10, 1994

[54] PUMP DISPENSING DEVICE

[75] Inventor: David J. Targell, Cambridge, United Kingdom

[73] Assignee: Bespak Plc., Norfolk, United Kingdom

[21] Appl. No.: 941,060

[22] PCT Filed: Apr. 29, 1991

[86] PCT No.: PCT/GB91/00677

§ 371 Date: Dec. 18, 1992

§ 102(e) Date: Dec. 18, 1992

[87] PCT Pub. No.: WO91/16993

PCT Pub. Date: Nov. 14, 1991

[30] Foreign Application Priority Data

May 1, 1990 [GB] United Kingdom ..... 9009715

[51] Int. Cl.[5] ..... B67D 5/64

[52] U.S. Cl. ..... 222/167; 222/321

[58] Field of Search ..... 222/167, 168, 321, 402.13, 222/509; 239/333

[56] References Cited

U.S. PATENT DOCUMENTS 3,746,261 7/1973 Nozawa et al. .
3,792,800 2/1974 Capra et al. .
3,901,414 8/1975 Capra et al. .
4,138,039 2/1979 Micallef ..... 222/321
4,264,037 4/1981 Nozawa ..... 222/321 X

FOREIGN PATENT DOCUMENTS 224531 10/1925 United Kingdom .
310818 6/1930 United Kingdom .
1100024 1/1968 United Kingdom .
1140422 1/1969 United Kingdom .
1202430 8/1970 United Kingdom .

*Primary Examiner*—Gregory L. Huson
*Attorney, Agent, or Firm*—Beveridge, DeGrandi, Weilacher & Young

[57] ABSTRACT

A dispensing device is described which is a pump for dispensing accurately metered amount of fluids in the form of a spray. The device has a piston sliding in a cylinder. A fluid inlet to the cylinder is normally closed off by a ball valve and, when open, communicates with an outlet passage leading to a swirl chamber and outlet nozzle. Cooperating first and second cam surfaces are provided on parts fixed to the cylinder and piston respectively so that relative rotational movement of the cam surfaces causes the piston to slide in the cylinder, the stroke being fixed by the profiles of the cam surfaces.

4 Claims, 3 Drawing Sheets

PUMP DISPENSING DEVICE

The invention relates to dispensing devices and more particularly to pump dispensing devices for dispensing fluids. The invention is particularly, though not exclusively, suitable for dispensing liquid medicaments.

In dispensing liquid medicaments, it is a requirement that the dispensing device is capable of dispensing an accurately metered dose of the medicament at each use of the device.

The invention provides a pump dispensing device comprising a piston sliding in a cylinder, a fluid inlet to the cylinder for product to be dispensed and a fluid outlet through the piston, valve means normally closing the fluid outlet and being opened in operation of the device, co-operating first and second cam surfaces being provided connected to the piston and cylinder respectively and means being provided for effecting relative movement of the cam surfaces to cause the piston to slide axially relative to the cylinder through a predetermined stroke characterised in that said valve means is resiliently urged into a closed position and is opened by fluid pressure as the piston slides in the cylinder.

Preferably the co-operating cam surfaces are axially directed and extend peripherally around the piston and cylinder, the movement effecting means operating to rotate the first cam surface relative to the second cam surface to cause the piston to slide axially in the cylinder.

The rotating means may comprise an actuator slidable transversely of the piston and cylinder and including means for engaging a portion of the cam surfaces to rotate the cam surfaces relative to one another.

The cam surfaces preferably have generally saw-tooth profiles.

A preferred embodiment of the invention will now be described, by way of example, with reference to the accompanying drawings in which.

Figure 1:
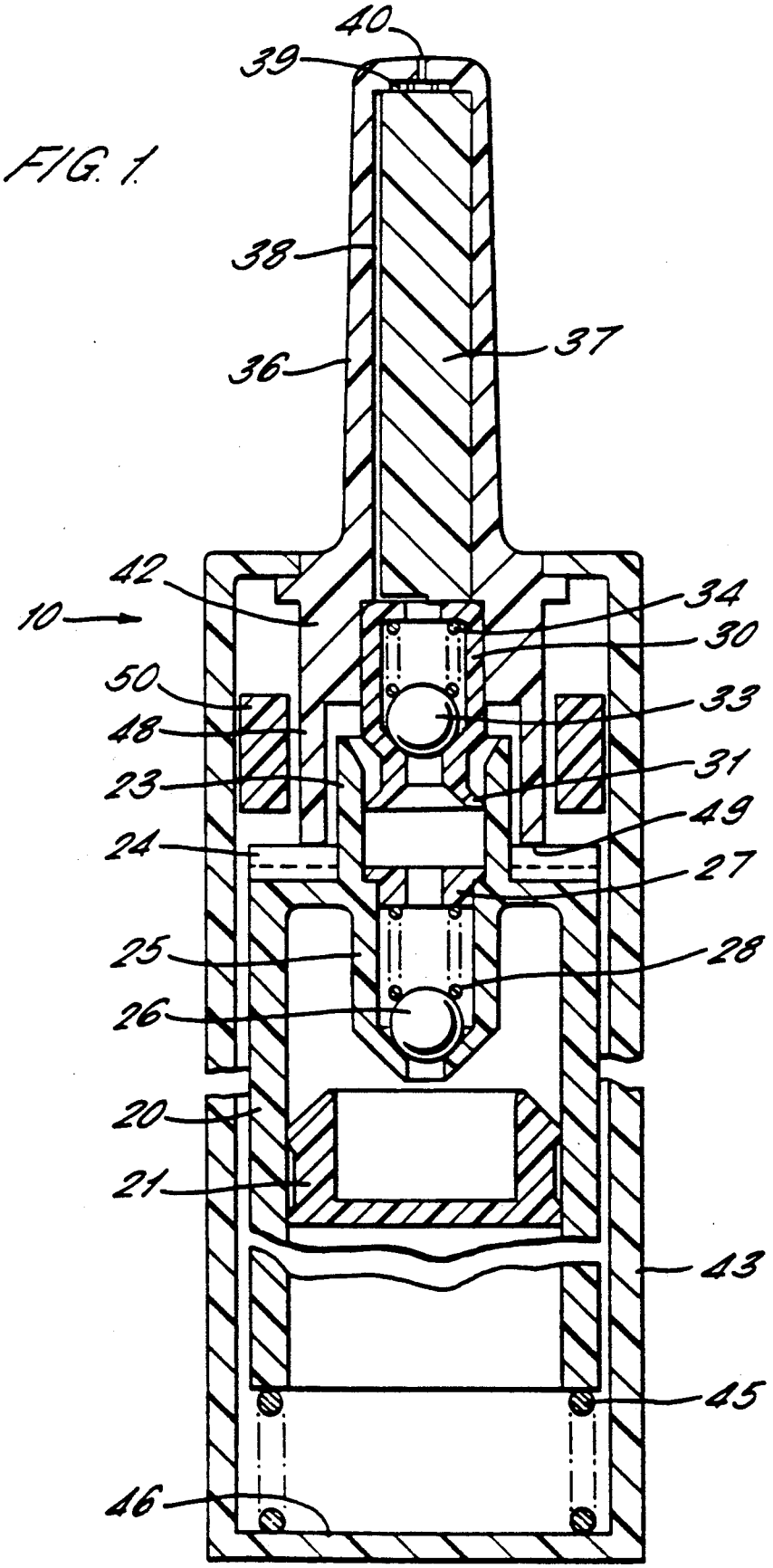
FIG. 1 is a longitudinal section through a dispensing device according to the invention and showing the device in a first position.

Referring first to FIG. 1, there is shown a pump dispensing device 10. The device is designed to provide accurately metered doses of a product contained in a product container or cartridge 20. The container 20 is open at its lower end and closed off by a sliding piston 21 so that the product is contained between the piston 21 and the upper end of container 20 as viewed in FIG. 1. The device is particularly suitable for dispensing liquid medicaments where it is important that accurately metered doses of the medicament are dispensed consistently.

Figure 2:
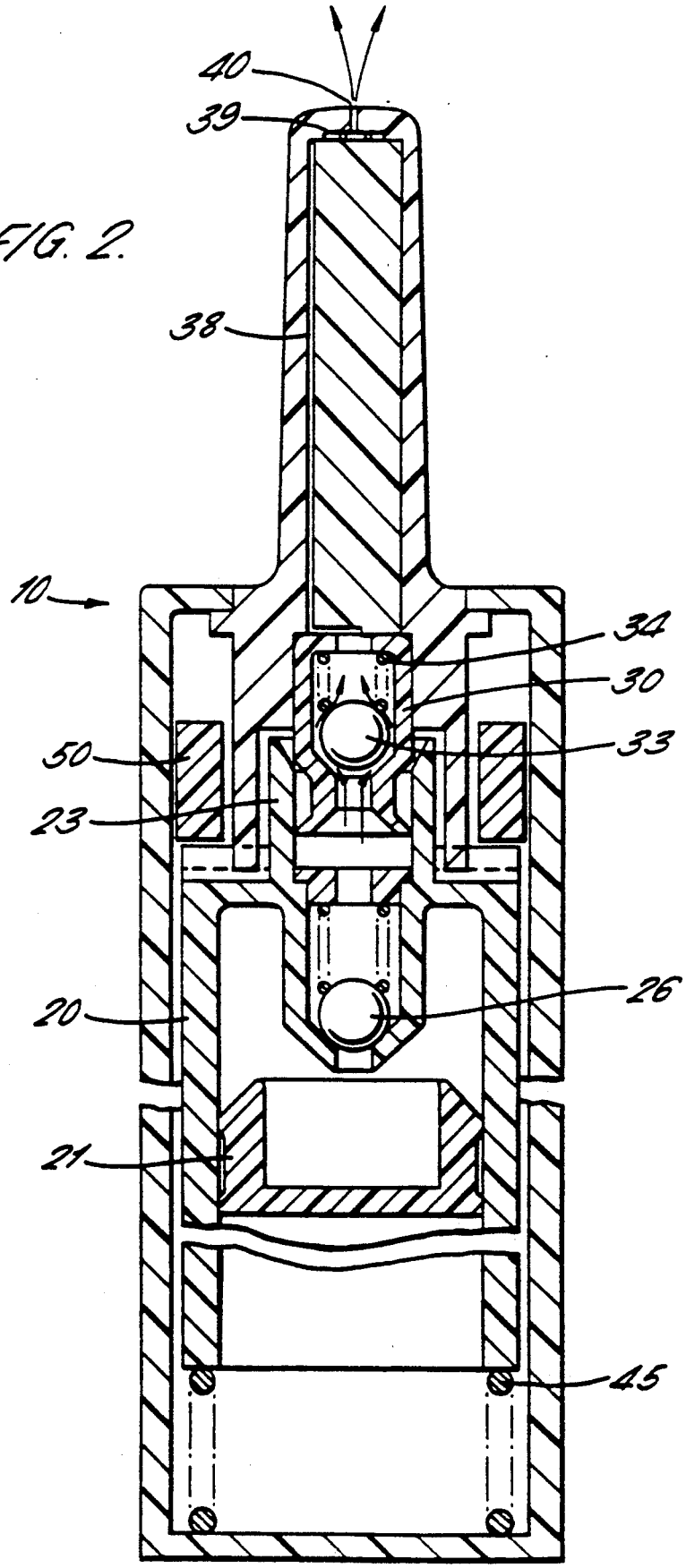
FIG. 2 is a view similar to FIG. 1 showing the device in a second position.
Figure 3:
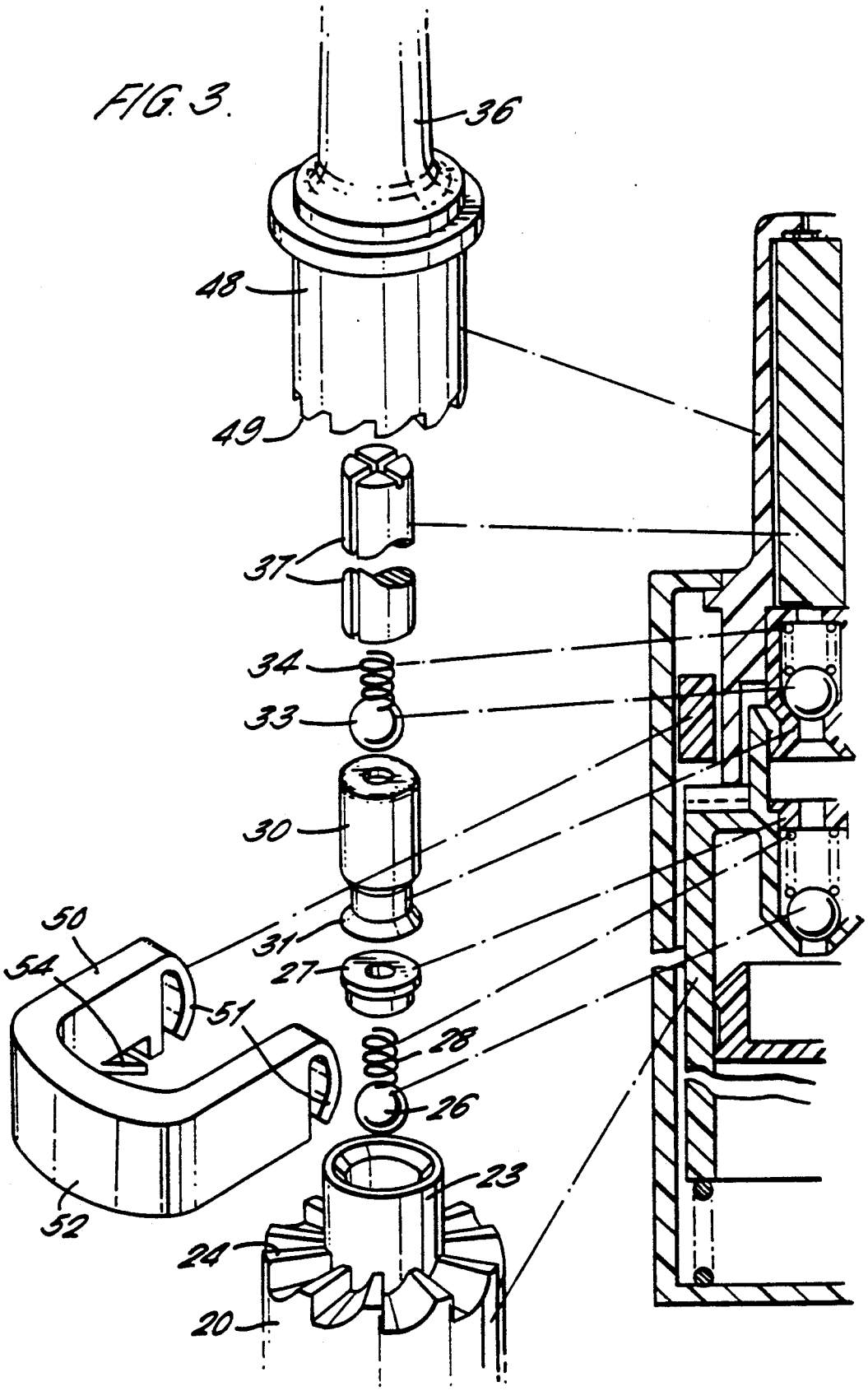
FIG. 3 is an exploded view of some of the components of the device of FIG. 1.

The product container 20 is formed at its upper end with a tubular extension 23. The annular surface around the tubular extension 23 is provided with a series of cam profiles 24 and these are more clearly seen in FIG. 3. The cam profiles form a generally saw-tooth configuration around the annular upper surface of container 20. The container 20 is also provided with an inwardly directed generally tubular part 25 at its upper end. The configuration of this part is shown in FIGS. 1 and 2 and provides a seating for a ball valve 26. A retaining plug 27 with a central orifice therethrough seats in the upper part of container 20 between the extensions 23 and 25 and retains a first spring 28 which normally urges the ball 26 into a closed position as shown in FIG. 1.

The tubular extension 23 of container 20 provides a cylinder for a piston member 30. The piston member is generally cylindrical and includes, as viewed in FIG. 1, a downwardly directed sealing lip 31 which is a sliding fit in cylinder 23. A fluid flow path extends through piston 30 and is normally closed off by a second ball valve 33 located in a seat within the piston 30 and spring urged by a second spring 34 into its closed position.

The piston 30 is fixed in a nozzle 36 of the device. The nozzle is generally tubular and includes an insert 37 which defines an outlet flow path 38 parallel to the axis of the nozzle and terminating in a swirl chamber 39 immediately adjacent to an outlet orifice 40 of the nozzle. The outlet passage 38 communicates at its lower end with the fluid flow passage through piston 30, the piston 30 being fixed in a tubular housing portion 42 of the nozzle 38.

The housing portion 42 of the nozzle 36 includes a downwardly directed tubular extension 48 (as viewed in FIG. 1) and the lower end of this extension 48 is formed with a series of cam surfaces 49 which correspond in shape to and co-operate with cam surfaces 24. This is illustrated most clearly in FIG. 3.

A generally cylindrical housing 43 for the device is fixed to a shoulder formed in the housing portion 42 of the nozzle 38 and surrounds the other components as shown in FIG. 1. A third spring 45 is located between a closed end 46 of the housing remote from the nozzle 36 and the open lower end of container 20.

An actuator 50 for effecting relative movement of the cam surfaces in the dispensing device extends through the wall of housing 43 for sliding movement in a direction perpendicular to the axis of the dispensing device. It will be appreciated that the remaining components described above are all arranged co-axially. The configuration of the actuator 50 is shown most clearly in FIG. 3. It is a generally U shaped member having resilient curved portions 51 formed at the end of each arm of the U shape, the closed end 52 extending through the wall of the housing 43 as described above. A resilient tang 54 projects downwardly from the actuator 50 for engagement with the cam profile 24. As the actuator slides inwardly relative to the housing 43, the tang 54 engages one of the cam profiles 24 to cause the container 20 to rotate relative to the housing 43 and nozzle 36. After the rotational movement has indexed the container through one cam profile, the resilient portions 51 cause the actuator 51 to spring back to its rest position. The effect of rotation of the container 20 will be described below.

At its rest position (not illustrated in the figures), the dispensing device 10 will have the cam profiles 24 and 49 interlocated so that the peaks of cam profiles 49 are in the troughs of cam profile 24 and vice versa. As the container 20 is rotated relative to the nozzle 36, the peaks of cam profiles 49 will slide upwardly along cam profile 24 until the device reaches the position shown in FIG. 1 where the peaks of the cam profiles 24 and 49 are in abutment. During this movement, the nozzle 36 and the components fixed thereto will move axially upwardly relative to the container 20 as viewed in FIG. 1. This movement causes the piston 30 to slide upwardly in the cylinder 23 thus creating a region of lower pressure in the metering chamber formed between the piston and cylinder, opening valve 26 against the action of spring 28 and drawing product into the metering chamber from the container 20. The pressure differential thus created across piston 21 will cause that piston to slide upwardly in the container 20 (as viewed in FIG. 1) so that the piston 21 is always in contact with the product. When the position shown in FIG. 1 has been reached, the metering chamber formed in cylinder 23 will be full of product.

Continued rotational movement of the container 20 relative to the nozzle 36 will put the device into the position shown in FIG. 2. It will be appreciated that this continued rotational movement will cause the peaks of cam profile 49 to pass the peaks of cam profile 24 so that there is a sudden and quick axial movement of the nozzle 36 and the components fixed thereto downwardly relative to the container 20 as viewed in FIG. 2. This movement will cause the piston 30 to move downwardly in the cylinder 23. Ball valve 26 will then immediately close and the downward movement of the piston will cause ball valve 33 to open against the action of spring 34 allowing the product stored in the metering chamber to be dispensed through the piston 30 along outlet passage 38 and through the outlet orifice 40 in the form of a spray created by swirl chamber 39. The rapid axial movement described above and illustrated in FIG. 2 is achieved by spring 45 which urges the container 20 upwardly relative to the nozzle 36. When the dispensing movement described above with reference to FIG. 2 has been completed, the components of the dispensing device return to the rest position described above.

It will be appreciated that the components of the pump dispensing device 10 are the same in both FIGS. 1 and 2 and reference numerals for all the parts of the device have not been repeated in FIG. 2 except where such reference numerals are useful because they refer to parts particularly described with reference to FIG. 2.

As described above, the pump dispensing device 10 is particularly suitable for dispensing liquid medicaments where it is necessary to dispense accurately metered doses on a repeatable basis. The dose dispensed by the device 10 is controlled by the size of the metering chamber formed in cylinder 23 by the movement of piston 30. It will be appreciated that the movement of piston 30 is very accurately controlled because its limit positions as shown in FIGS. 1 and 2 are determined by the cam profiles 24 and 49. These cam profiles may be manufactured with great accuracy and this ensures that the stroke of piston 30 is accurately controlled between its limit positions. Although the materials of the various components of the dispensing device 10 have not been described in detail, the majority of these will generally be plastics mouldings with the exception of the ball valves 26, 33 and the springs.

The invention is not limited to the preferred embodiment described above and various modifications may be made. For example, the actuator 50 is described as having a downwardly direct tang 54 which engages the cam profiles 24, the cam profiles 24 also co-operating with cam profiles 49. It will be appreciated that a modification may be made to provide an inwardly directed tang on the actuator 50, radially directed cam profiles being provided on the container 20 for co-operation with this tang.

I claim:

1. A pump dispensing device comprising a piston sliding in a cylinder, a fluid inlet to the cylinder for product to be dispensed and a fluid outlet through the piston, valve means normally closing the fluid outlet and being opened in operation of the device, cooperating first and second cam surfaces being provided connected to the piston and cylinder respectively and means being provided for effecting relative movement of the cam surfaces to cause the piston to slide axially relative to the cylinder through a predetermined stroke, said valve means being resiliently urged into a closed position and opened by fluid pressure as the piston slides in the cylinder, in which the cooperating cam surfaces are axially directed and extend peripherally around the piston and cylinder, the movement effecting means operating to rotate the first cam surface relative to the second cam surface to cause the piston to slide axially in the cylinder.

2. A device as claimed in claim 1 characterised in that the rotating means comprises an actuator slidable transversely of the piston and cylinder and including means for engaging a portion of the cam surfaces to rotate the cam surfaces relative to one another.

3. A device as claimed in claim 1 characterised in that the cam surfaces have generally saw-tooth profiles.

4. A device as claimed in claim 2 characterised in that the cam surfaces have generally saw-tooth profiles.

* * * * *